US007252548B2

(12) United States Patent
Huang

(10) Patent No.: US 7,252,548 B2
(45) Date of Patent: Aug. 7, 2007

(54) HDMI ELECTRICAL CONNECTOR

(75) Inventor: Hung-Way Huang, Taipei Hsien (TW)

(73) Assignee: Advanced Connectek Inc., Taipei Hsien (TW)

( * ) Notice: Subject to any disclaimer, the term of this patent is extended or adjusted under 35 U.S.C. 154(b) by 0 days.

(21) Appl. No.: 11/366,575

(22) Filed: Mar. 3, 2006

(65) Prior Publication Data

US 2006/0148319 A1 Jul. 6, 2006

Related U.S. Application Data

(63) Continuation-in-part of application No. 11/011,125, filed on Dec. 15, 2004, now abandoned.

(30) Foreign Application Priority Data

May 13, 2004 (TW) ..... 93207453 U

(51) Int. Cl.
*H01R 13/648* (2006.01)

(52) U.S. Cl. ..... 439/607

(58) Field of Classification Search ..... 439/607, 439/608, 609, 610, 355, 357, 108
See application file for complete search history.

(56) References Cited

U.S. PATENT DOCUMENTS

| | | | | |
|---|---|---|---|---|
| 5,052,949 | A * | 10/1991 | Lopata et al. | 439/610 |
| 5,718,605 | A * | 2/1998 | Morikawa et al. | 439/607 |
| 6,165,017 | A * | 12/2000 | Kuo | 439/610 |
| 6,257,914 | B1 * | 7/2001 | Comerci et al. | 439/357 |
| 6,264,504 | B1 * | 7/2001 | Wu | 439/607 |
| 6,398,587 | B1 * | 6/2002 | Chen et al. | 439/607 |

* cited by examiner

*Primary Examiner*—Chandrika Prasad
(74) *Attorney, Agent, or Firm*—Troxell Law Office, PLLC

(57) ABSTRACT

A HDMI type electrical connector assembly includes an insulative body comprising at least one top recess having at least one top tab, and at least one bottom tab; parallel conductors; a metal front housing formed by bending a metal sheet and comprising a front projected sheath including upper and lower flanges extended rearwards for fastening the insulative body and the rear member; a conductor mounting unit consisting of a rear member including two side protrusions, and upper and lower holding members together for pressing the rear member therebetween; and a plastic case comprising top and bottom shells each having a U section and comprising latches and holes disposed on both sidewalls such that the bottom and the top shells can be matingly coupled together.

6 Claims, 5 Drawing Sheets

HDMI ELECTRICAL CONNECTOR

This is a continuation-in-part of U.S. patent application Ser. No. 11/011,125, filed on Dec. 15, 2004 now abandoned in the name of Huang, Hung-Way and entitled "ELECTRICAL CONNECTOR" is now pending.

BACKGROUND OF THE INVENTION

1. Field of the Invention

The present invention relates to electrical connectors and more particularly to a HDMI (High Definition Multimedia Interface) type electrical connector assembly with improved characteristics.

2. Description of Related Art

Electrical connectors are employed in the ends of cables for electrically coupling two electronic devices together for signal communication therebetween. Also, a wide variety of advanced electronic products such as LCDs (liquid crystal displays) are commercially available as time evolves. Thus, continuing improvements in the exploitation of electrical connector are constantly being sought by the manufacturers for meeting existing electrical requirements. For instance, HDMI (High Definition Multimedia Interface) type electrical connectors are newly developed. HDMI type connectors have the advantages of DVI (digital video interface) type connectors while without its disadvantages. Also, HDMI type connectors are much compact for being easily adapted to mount in an AV (audio video) product.

However, metal shrouds of the well known HDMI type connectors suffered from several disadvantages including low precision, being difficult of being machined, and low yield due to the undesired extrusion process. Thus, it is desirable to provide an improved HDMI type electrical connector.

SUMMARY OF THE INVENTION

It is an object of the present invention to provide an electrical connector assembly being formed by a simple bending process so as to facilitate assembly.

It is another object of the present invention to provide an electrical connector assembly having all components concealed so as to substantially eliminate EMI during operating.

It is a further object of the present invention to provide an electrical connector assembly having a plurality of fastening arrangements in a metal front housing and a plastic case such that fastening of the internal components is more reliable.

To achieve the above and other objects, the present invention provides an electrical connector assembly comprising an insulative body comprising a parallelepiped rear member including at least one top recess having at least one top tab, and at least one bottom tab; a plurality of parallel conductors; a conductor mounting unit including: an upper holding member comprising a body, a plurality of lengthwise bottom grooves being not identical each other, an enlargement formed between two adjacent grooves, two side projections formed on the enlargement, a hole formed through either side of the body, and two slits formed on the body; a lower holding member comprising a body, a plurality of lengthwise top grooves being not identical each other, an enlargement formed between two adjacent grooves, two side projections formed on the enlargement, a hole formed through either side of the body, and two slits formed on the body; and a rear member comprising a rectangular plate including a plurality of rear troughs, two top side posts, and two bottom side posts, two latches extended from two front corners of the plate, and a conductor receiving unit including a projected front opening, a plurality of cavities in the front opening, and two indentations proximate two ends of the front opening, a zone formed on each of top and bottom of the front opening, a slope extended from a top edge of the front opening to a front end of the zone, and two platforms formed at both sides of the zone; a metal front housing formed by bending a metal sheet and comprising a front projected sheath including upper and lower flanges extended rearwards for fastening the insulative body and the rear member together; and a case comprising a top shell of U section including a plurality of latches disposed on its sidewall, and a bottom shell of U section including a plurality of latches disposed on its sidewall such that the latches are adapted to snap into place on the bottom shell and the latches are adapted to snap into place on the top shell for fastening both the bottom and the top shells together; wherein the conductors are placed in the grooves, the enlargements are inserted into the troughs for fastening the conductors therein by squeezing the enlargements and the projections, in the troughs, portions of the conductors to be soldered are extended to position in the zone, the posts are inserted into the holes, for assembling the rear member, the upper holding member, and the lower holding member together, and the latches are inserted into the openings, for fastening so as to finish an assembly of the conductor mounting unit; and an assembly of the connector assembly is finished after assembling the front housing with the body, the conductors, and the conductor mounting unit.

The above and other objects, features and advantages of the present invention will become apparent from the following detailed description taken with the accompanying drawings.

DETAILED DESCRIPTION OF THE PREFERRED EMBODIMENTS

Figure 1:
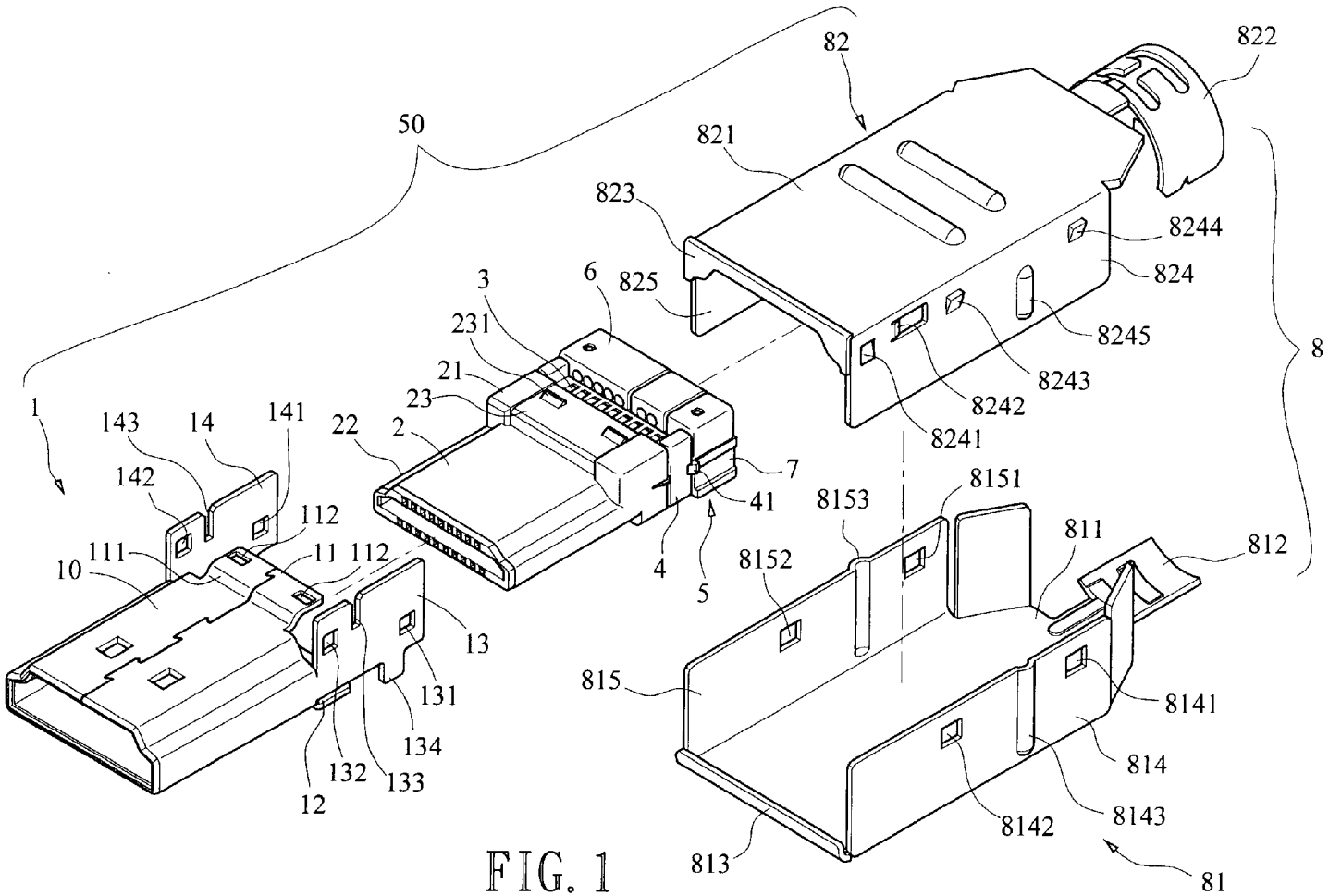
FIG. 1 is an exploded perspective view of a preferred embodiment of electrical connector assembly according to the invention.
Figure 2:
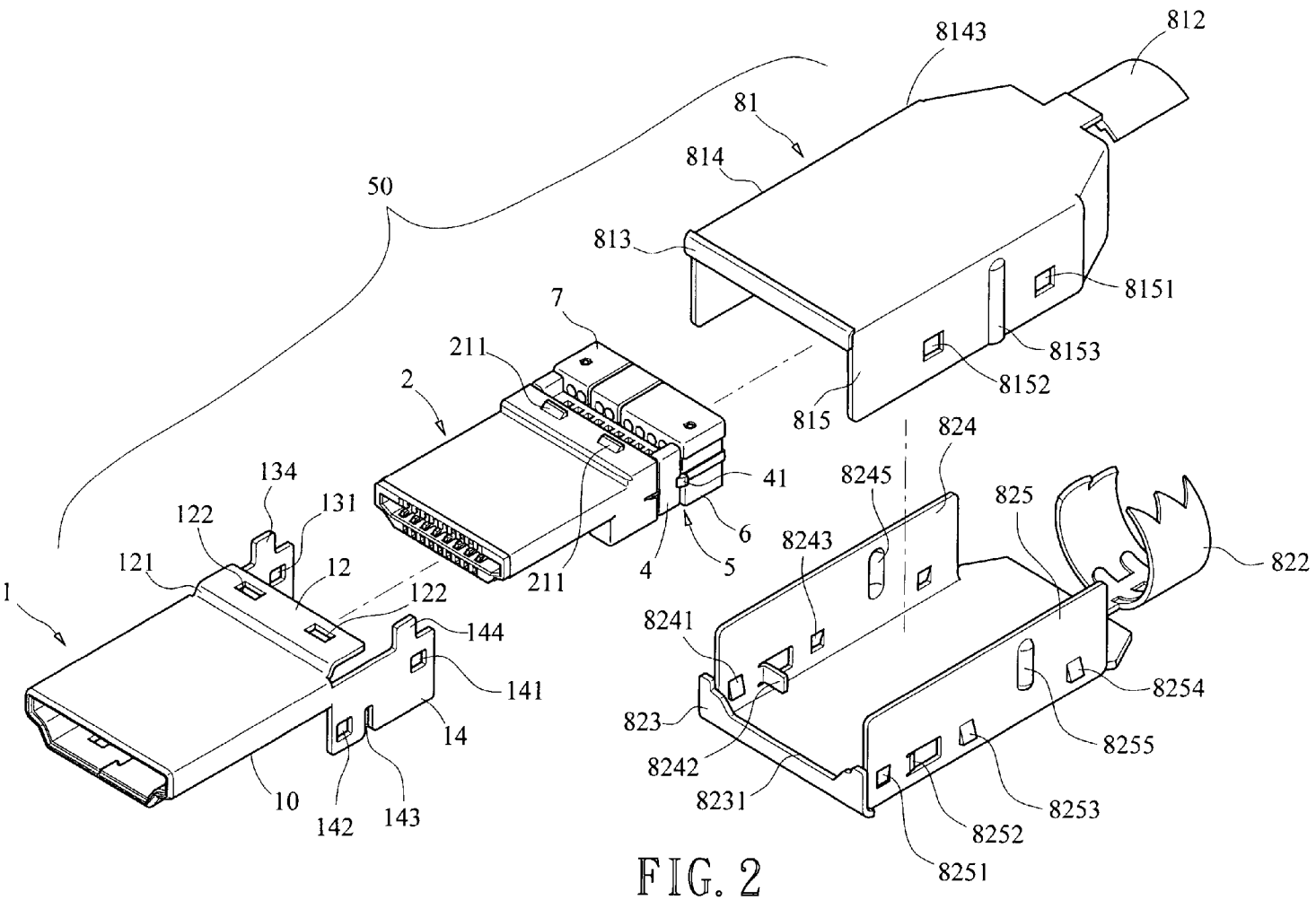
FIG. 2 is another exploded perspective view of the electrical connector assembly shown in FIG. 1 viewed oppositely.
Figure 3:
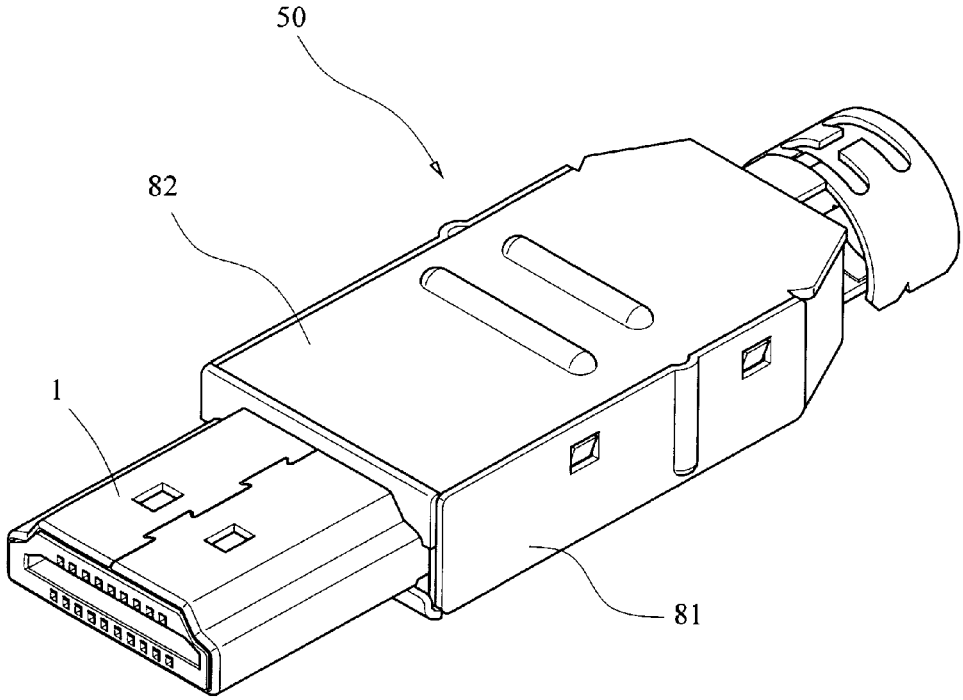
FIG. 3 is a perspective view of the assembled electrical connector assembly.

Referring to FIGS. 1 to 3, there is shown a HDMI type electrical connector assembly 50 constructed in accordance with a preferred embodiment of the invention.

The parallelepiped connector assembly 50 comprises a metal front housing 1, an insulative body 2, a plurality of parallel conductors 3, a rear member 4, an upper holding member 6, a lower holding member 7, and a plastic case 8. Each component will be described in detailed below.

The front housing 1 is formed by bending a metal sheet and comprises a front projected sheath 10 having a HDMI type opening at either end, upper and lower flanges 11, 12 each having a bent member 111 or 121 formed with the sheath 10, a pair of openings 112 formed on the upper flange 11, a pair of openings 122 formed on the lower flange 12, right and left positioning members 13, 14 protruded rearwards from a rear end, a pair of openings 131, 132 formed on the right positioning member 13, a pair of openings 141, 142 formed on the left positioning member 14, an upper dent 133 formed on the right positioning member 13, an upper dent 143 formed on the left positioning member 14, a lower leg 134 formed on the right positioning member 13, and a lower leg 144 formed on the left positioning member 14.

The insulative body 2 comprises a rear parallelepiped member 21 and a forward extension 22. A recess 23 is provided on a top of the parallelepiped member 21. The recess has a width conformed to that of the upper flange 11. Two tabs 231 are provided on the recess 23 and are adapted to insert in the openings 112 for fastening. Also, two tabs 211 are provided on a bottom of the parallelepiped member 21 and are adapted to insert in the openings 122 for fastening.

Figure 4:
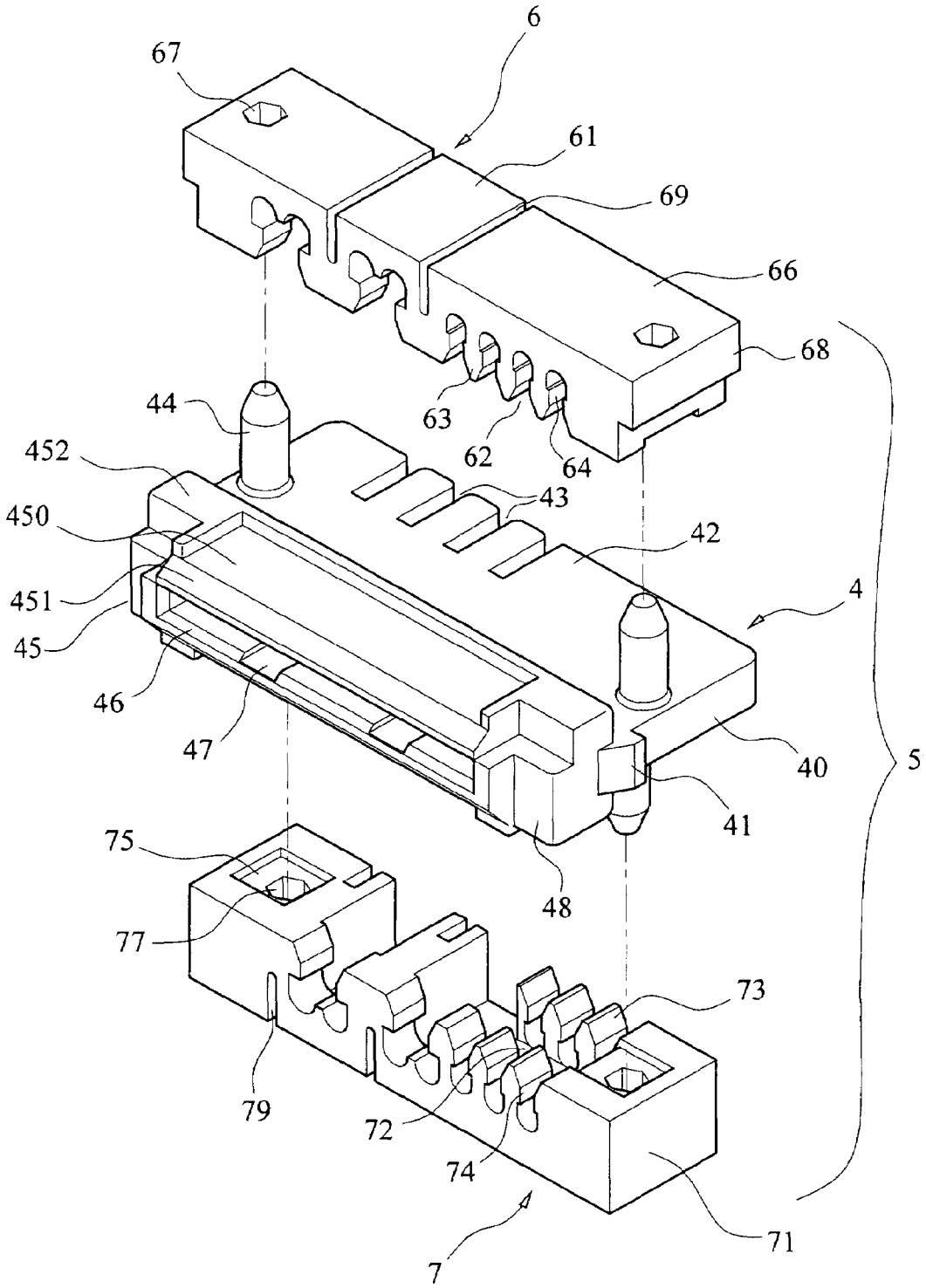
FIG. 4 is an exploded perspective view of a conductor mounting unit consisting of the rear member, the upper holding member, and the lower holding member.
Figure 5:
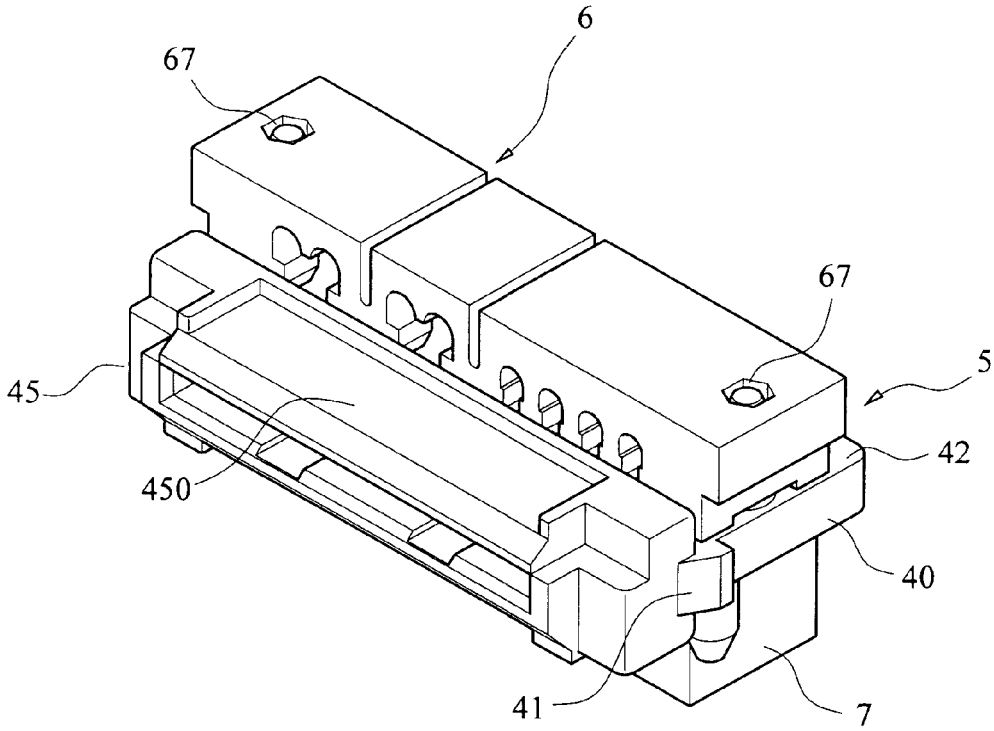
FIG. 5 is a perspective view of the assembled conductor mounting unit.
Figure 6:
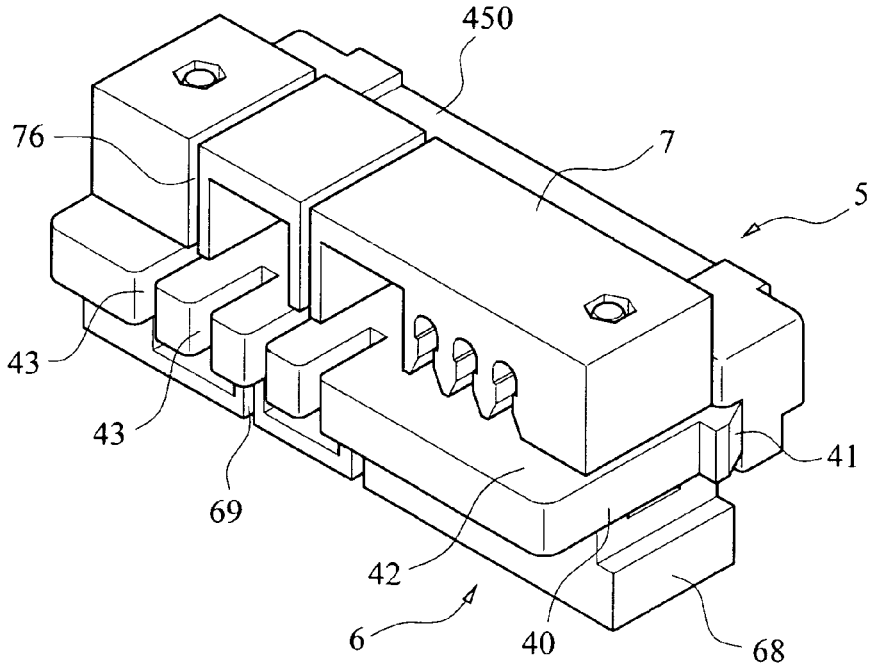
FIG. 6 is a perspective view of the assembled conductor mounting unit shown in FIG. 5 viewed oppositely.

Referring to FIGS. 4 to 6, there is shown a conductor mounting unit 5 consisting of the rear member 4, the upper holding member 6, and the lower holding member 7. The rear member 4 comprises a rectangular plate 42 and a conductor receiving unit 45. The plate 42 comprises a plurality of troughs 43 along the rear end, two top posts 44 proximate sides 40, and two bottom posts 44 proximate sides 40. The top posts 44 are adapted to insert into two side holes 67 of the upper holding member 6 for fastening the rear member 4 and the upper holding member 6 together. The rear member 4 further comprises two latches 41 extended from two front corners of the plate 42. The latches 41 are adapted to insert into the openings 131, 141 for fastening the rear member 4.

The conductor receiving unit 45 comprises a projected front opening 46, a plurality of cavities 47 in the front opening 46, and two indentations 48 proximate two ends of the front opening 46. A zone 450 is formed on each of top and bottom of the front opening 46 and is adapted to rest conductors thereon. A slope 451 is extended from a top edge of the front opening 46 to a front end of the zone 450. Two platforms 452 are formed at both sides of the zone 450 and are served as fastening means.

The upper holding member 6 and the lower holding member 7 are substantially the same in construction. The upper holding member 6 comprises a body 61 and the lower holding member 7 comprises a body 71 respectively. A plurality of lengthwise grooves 62 are formed on a bottom of the upper holding member 6. A plurality of lengthwise grooves 72 are formed on a top of the lower holding member 7. The grooves 62, 72 are not identical each other so as to receive conductors of different widths. An enlargement 63 is formed between two adjacent grooves 62 and an enlargement 73 is formed between two adjacent grooves 72 respectively. Two side projections 64 are formed on the enlargement 63 and two side projections 74 are formed on the enlargement 73 respectively. Conductors received in the grooves 62, 72 are thus fastened by the projections 64, 74. A well 65 (not shown) is formed on either side of the body 61 and a well 75 is formed on either side of the body 71 respectively. The bottom posts 44 are adapted to insert into holes 77 in the wells 75 of the lower holding member 7 for fastening the rear member 4 and the lower holding member 7 together. Two slits 69 are formed on the body 61 and two slits 79 are formed on the body 71 respectively. The slits 69, 79 are cooperated with the troughs 43 for fastening the conductors in the grooves 62, 72.

Following is a description of the assembly of the conductor mounting unit 5 of the invention. First, place a first portion of conductors in the grooves 62 of the upper holding member 6 and conductors in the grooves 72 of the lower holding member 7 respectively. Then place a second portion of conductors into the troughs 43 such that conductors are fastened in the troughs 43 and also in the grooves 62 of the upper holding member 6 and the grooves 72 of the lower holding member 7. Portions of conductors to be soldered are extended to position in the zone 450. Next, insert the posts 44 into the holes 67 for assembling the rear member 4, the upper holding member 6, and the lower holding member 7 together. Finally, insert the latches 41 into the openings 131, 141 for finishing the assembly of the conductor mounting unit 5.

A next stage of assembly of the connector assembly 50 is finished after assembling the front housing 1 with the body 2, the conductors 3, and the conductor mounting unit 5.

The parallelepiped case 8 comprises a top shell 82 and a bottom shell 81 each formed by bending a metal sheet. The bottom shell 81 comprises a rectangular flat 811, a curved rear extension 812 formed with the flat 811, an elongate lip 813 at a forward end, the lip 813 adapted to snap onto the bent member 121, two sidewalls 814, 815, two openings 8141, 8142 formed on one sidewall 814, two openings 8151, 8152 formed on the other sidewall 815, an upright trough 8143 having a curved section provided between the openings 8141 and 8142, and an upright trough 8153 having a curved section provided between the openings 8151 and 8152.

The top shell 82 comprises a rectangular flat 821, a curved rear extension 822 formed with the flat 821, the extensions 812 and 822 together adapted to clamp a passed cable, an elongate lip 823 at a forward end, the lip 823 having a groove 8231 in its intermediate portion to be matingly engaged with an outer surface of the sheath 10, the lip 823 adapted to snap onto the bent member 111, the lips 813 and 823 together adapted to prevent a removal of the components provided in the case 8, two sidewalls 824, 825, two protuberances 8241, 8251 provided on both sidewalls 824, 825 adjacent the lips 823, the protuberances 8241, 8251 adapted to insert into the openings 132, 142 for fastening, latches 8242, 8252 provided on both sidewalls 824, 825 adjacent the protuberances 8241, 8251 respectively, the latches 8242, 8252 adapted to insert into the dents 133, 143 for fastening, a pair of tabs 8243, 8244 provided on the sidewall 824, the tabs 8243, 8244 being at the same elevation as the protuberance 8241 and the latch 8242, the tabs 8243, 8244 adapted to insert into the openings 8141, 8142 for fastening respectively, a pair of tabs 8253, 8254 provided on the sidewall 825, the tabs 8253, 8254 being at the same elevation as the protuberance 8251 and the latch 8252, the tabs 8253, 8254 adapted to insert into the openings 8151, 8152 for fastening respectively, an upright projection 8245 having a curved section provided between the tabs 8243 and 8244, the projection 8245 adapted to slide into the trough 8143 for positioning, and an upright projection 8255 having a curved section provided between the tabs 8253 and 8254, the projection 8255 adapted to slide into the trough 8153 for positioning. As a result, the top shell 82 and the bottom shell 81 are fastened together. This finishes the assembly of the connector assembly 50 as shown in FIG. 3.

Note that suitable gaps should be provided on the sides of the body 2 after assembling the body 2 and the rear member 4 such that the latches 8242, 8252 are adapted to insert thereinto later.

The benefits of the invention include: As compared with the prior extrusion process, the bending process of the invention is much simple and an assembly thereof is much easy. Also, many fastening arrangements are provided in the front housing 1 and the case 8 such that the fastening of the internal components is more reliable. Moreover, both signal transmission quality and speed are increased.

While the invention herein disclosed has been described by means of specific embodiments, numerous modifications and variations could be made thereto by those skilled in the art without departing from the scope and spirit of the invention set forth in the claims.

What is claimed is:

1. An HDMI (High Definition Multimedia Interface) type electrical connector assembly (50) comprising:

an insulative body (2) comprising at least one top recess (23) having at least one top tab (231), and at least one bottom tab (211);

a plurality of parallel conductors (3);

a conductor mounting unit (5) including:

an upper holding member (6) comprising a body (61), a plurality of lengthwise bottom grooves (62) being not identical each other, an enlargement (63) formed between two adjacent grooves (62), two side projections (64) formed on the enlargement (63), a hole (67) formed through either side of the body (61), and two slits (69) formed on the body (61);

a lower holding member (7) comprising a body (71), a plurality of lengthwise top grooves (72) being not identical each other, an enlargement (73) formed between two adjacent grooves (72), two side projections (74) formed on the enlargement (73), a hole (77) formed through either side of the body (61), and two slits (79) formed on the body (71); and a rear member (4) comprising a rectangular plate (42) including a plurality of rear troughs (43), two top side posts (44), and two bottom side posts (44), two latches (41) extended from two front corners of the plate (42), and a conductor receiving unit (45) including a projected front opening (46), a plurality of cavities (47) in the front opening (46), and two indentations (48) proximate two ends of the front opening (46), a zone (450) formed on each of top and bottom of the front opening (46), a slope (451) extended from a top edge of the front opening (46) to a front end of the zone (450), and two platforms (452) formed at both sides of the zone (450);

a metal front housing (1) formed by bending a metal sheet and comprising a front projected sheath (10) including upper and lower flanges (11, 12) extended rearwards for fastening the insulative body (2), the rear member (4) and the conductor mounting unit (5) together; and a case (8) comprising a top shell (82) of U section including a plurality of latches (8242, 8252) disposed on its sidewall (824, 825), and a bottom shell (81) of U section including a plurality of latches (8142, 8152) disposed on its sidewall (814, 815) such that the latches (8242, 8252) on the top shell (82) are adapted to snap into place on the bottom shell (81) and the latches (8142, 8152) on the bottom shell (81) are adapted to snap into place on the top shell (82) for fastening both the bottom and the top shells (81, 82) together;

wherein the conductors (3) are placed in the grooves (62, 72) for fastening the conductors (3) therein and then the same squeezing in the troughs (43), portions of the conductors (3) to be soldered are extended to position in the zone (450), the posts (44) are inserted into the holes (67, 76) for assembling the rear member (4), the upper holding member (6), and the lower holding member (7) together, and the latches (41) are inserted into openings (131, 141) for fastening so as to finish an assembly of the conductor mounting unit (5); and an assembly of the connector assembly (50) is finished after assembling the front housing (1) with the body (2), the conductors (3), and the conductor mounting unit (5).

2. The electrical connector of claim 1, wherein the upper flange (11) comprises two openings (112) adapted to receive the inserted top tabs (231) for fastening, the lower flange (12) comprises two openings (122) adapted to receive the inserted bottom tabs (211) for fastening, and the sheath (10) comprises two side positioning members (13, 14) protruded rearwards, the positioning member (13) including two second openings (131,132), an upper dent (133), and a lower leg (134), and the positioning member (14) including two second openings (141,142), an upper dent (143), and a lower leg (144).

3. The electrical connector of claim 2, wherein the upper flange (11) further comprises a bent member (111) formed with the sheath (10), the lower flange (12) further comprises a bent member (121) formed with the sheath (10), the upper flange (11) has a width substantially the same as that of the recess (23), and the lower flange (12) has a width substantially the same as that of the sheath (10).

4. The electrical connector of claim 1, wherein the bottom shell (81) comprises a curved rear extension (812), an elongate lip (813) disposed at a forward end, two openings (8141, 8142) formed on one sidewall (814) thereof two openings (8151, 8152) formed on the other sidewall (815) thereof, and two troughs (8143, 8153) having a curved section each disposed between the openings (8151, 8152).

5. The electrical connector of claim 1, wherein the top shell (82) comprises a curved rear extension (822) together with the rear extension (812) for clamping a passed cable, an elongate lip (823) disposed at a forward end, two side protuberances (8241, 8251) disposed adjacent the lip (823), the protuberances (8241, 8251) adapted to insert into the second openings (132,142) for fastening, two side latches (8242, 8252) disposed adjacent the protuberances (8241, 8251), the latches (8242, 8252) adapted to insert into the dents (133, 143) for fastening, two side tabs (8243, 8244, 8253, 8254) having the same elevation as the protuberances (8241, 8251) and the latches (8242, 8252) and being adapted to insert into the openings (8142, 8152) for fastening, and two side projections (8245; 8255) having a curved section each disposed between the tabs (8243, 8244; 8253, 8254), the projections (8245, 8255) adapted to slide into the troughs (8143, 8153) for positioning.

6. The electrical connector of claim 5, wherein the lip (823) comprises an intermediate groove (8231) matingly engaged with an outer surface of the sheath (10).

* * * * *